United States Patent [19]

Gilbert

[11] 4,015,649

[45] Apr. 5, 1977

[54] WOOD PLANES

[75] Inventor: Richard Gilbert, Dronfield, England

[73] Assignee: Stanley Tools Limited, Woodside, England

[22] Filed: Oct. 21, 1975

[21] Appl. No.: 624,313

[30] Foreign Application Priority Data

Oct. 29, 1974 United Kingdom ..... 46848/74

[52] U.S. Cl. ..... 145/11; 145/14; 145/16; 145/17

[51] Int. Cl.[2] ..... B27G 17/02

[58] Field of Search ..... 145/16, 17, 14, 11, 145/5 R, 13

[56] References Cited

UNITED STATES PATENTS

| | | | |
|---|---|---|---|
| 144,823 | 11/1873 | Baldwin | 145/14 |
| 313,694 | 3/1885 | Tidgewell | 145/14 |
| 508,386 | 11/1893 | Hayworth | 145/16 |
| 779,392 | 1/1905 | Bjordal | 145/14 |
| 1,124,325 | 1/1915 | Page | 145/16 |
| 1,151,301 | 8/1915 | Sparks | 145/14 |
| 1,587,746 | 6/1926 | Basmaison | 145/17 |
| 1,726,124 | 8/1929 | Rodionoff | 145/16 |
| 1,823,383 | 9/1931 | Weller et al. | 145/12 |
| 2,575,787 | 11/1951 | Binger | 145/14 |
| 3,120,250 | 2/1964 | Dakin | 145/11 |

FOREIGN PATENTS OR APPLICATIONS

| | | | |
|---|---|---|---|
| 271,190 | 1/1951 | Switzerland | 145/16 |
| 185,203 | 8/1922 | United Kingdom | 145/16 |
| 1,716 | 5/1874 | United Kingdom | 145/5 R |
| 5,307 | 3/1899 | United Kingdom | 145/14 |

*Primary Examiner*—Al Lawrence Smith
*Assistant Examiner*—J. T. Zatarga
*Attorney, Agent, or Firm*—Prutzman, Hayes, Kalb & Chilton

[57] ABSTRACT

A plane for use with disposable blades (whose longest dimension is parallel to the cutting edge) has a blade-holding part in which the blade can be released by a quick-release lever from being clamped between a rigid member and a spring-biased sheet metal member, the quick-release lever releasably supporting a bar member which engages a clamping bolt. Depth of cut is controlled by a rotary knob engaging an element intermediate the knob and the blade-holding part to move both the intermediate element and the blade-holding part up and down. Slewing of the lever is achieved by a lever which slides the blade-holding part sideways in its rib-and-groove engagement with the intermediate element.

3 Claims, 12 Drawing Figures

FIG. 4.
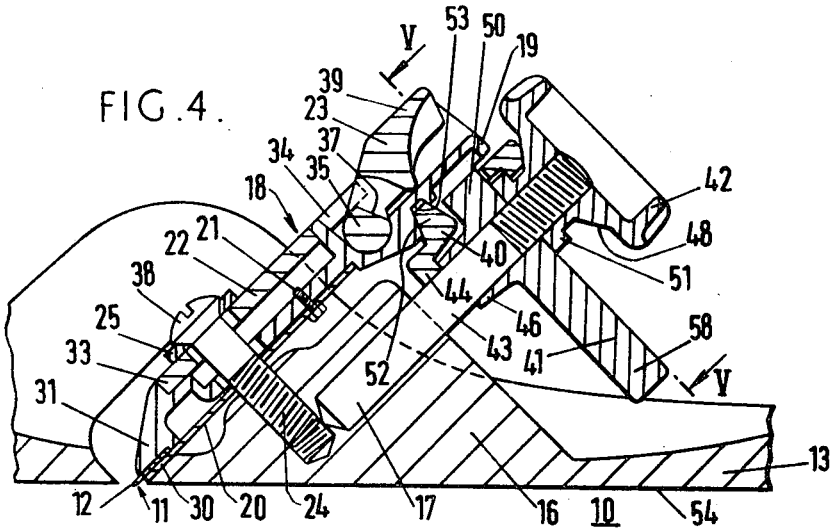
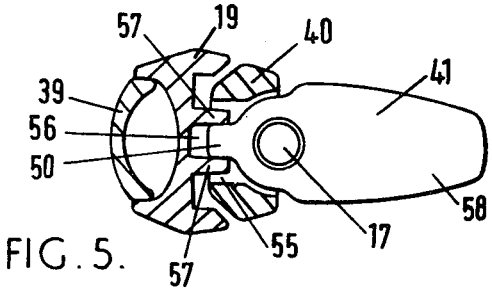
FIG. 5.
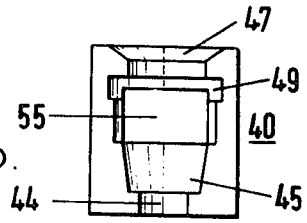
FIG. 6.

WOOD PLANES

BACKGROUND OF THE INVENTION

1. Field of the Invention

This invention relates to planes, particularly but not solely disposable blade planes, by which is meant planes adapted to be fitted with disposable blades.

2. Description of the Prior Art

Some planes are adapted to be fitted with blades of a type whose maximum dimension is not parallel but perpendicular to the direction of the cutting edge of the blade. Such blades are accordingly relatively large and expensive and are not therefore to be regarded as disposable. On the contrary, one would expect to have to sharpen the cutting edges of such blades from time to time.

Other planes are adapted to be fitted with blades of a type whose maximum dimension is parallel to the direction of the cutting edge of the blade. Such blades are accordingly relatively small and inexpensive and may therefore be regarded as disposable, although sharpening of the cutting edges of such blades is usually possible if desired.

Fairly obviously, the design of the blade-holding part of the plane depends upon whether the blade is to be of the relatively large, non-disposable type or the relatively small, disposable type.

It is an object of the invention in one of its aspects to provide a disposable blade plane adapted for rapid adjustability of the coarseness of cut and rapid levelling of the blade and preferably rapid removal and replacement of the blade, combined with firm location of the blade during use.

SUMMARY

According to one aspect of the invention there is provided a disposable blade plane comprising a blade-holding part which can be advanced and retracted for adjusting the coarseness of cut and which can be slewed for levelling the blade, a rotary adjustment member screw-threadedly engaging a fixed part of the plane and operable for advancing and retracting the blade-holding part, an element interposed between the blade-holding part and the rotary adjustment member, the element engaging the rotary adjustment member so that rotation of said rotary adjustment member in each direction causes advancement or retraction respectively of the element without rotation of the element, the element engaging the blade-holding part to cause advancement or retraction respectively of the blade-holding part while permitting slewing of the blade-holding part relative to the element.

Preferably, the engagement between the element and the blade-holding part is by means of a general transverse rib on one engaging in a mating groove in the other, the rib and groove being tapered in cross-section to provide sufficient friction therebetween to avoid unwanted slewing of the blade-holding part.

Preferably, the element bears at one end thereof upon a fixed stud and at the other end upon the rotary adjustment member, the said rib and groove being nearer to said one end than to said other end.

Preferably, the blade-holding part comprises a rigid member, a sheet metal member on the underside of the rigid member spring-biased away from the rigid member and a device for clamping the blade between the rigid member and the sheet metal member against the spring bias.

Preferably, the blade-holding part is secured to the body of the plane by means of a threaded bolt extending through an elongate slot in the blade-holding part, the head of the bolt engaging a member which forms part of the blade-holding part and which is supported partly by a quick-release member which is selectively operable to loosen the bolt to permit removal and replacement of the blade.

Preferably, a slewing adjustment lever is pivoted on the fixed part of the plane and engages the blade-holding part.

Preferably, the plane comprises a handle which is adapted to contain at least one spare blade.

According to another aspect of the invention there is provided a plane having a handle adapted to contain at least one spare blade.

According to another respect of the invention there is provided a plane comprising a body and a blade-holding part mounted adjustably on the body, wherein the blade-holding part comprises a rigid member, a sheet metal member on the underside of the rigid member spring-biased away from the rigid member and a device for clamping the blade between the rigid member and the sheet metal member against the spring bias.

BRIEF DESCRIPTION OF THE DRAWINGS

FIG. 4 is a section along line IV—IV of FIG. 3;

FIG. 5 is a section along line V—V of FIG. 4;

FIG. 6 is an underneath view (perpendicular to line V—V) of an element of the plane of FIGS. 1 to 5;

DESCRIPTION OF PREFERRED EMBODIMENTS

Figure 1:
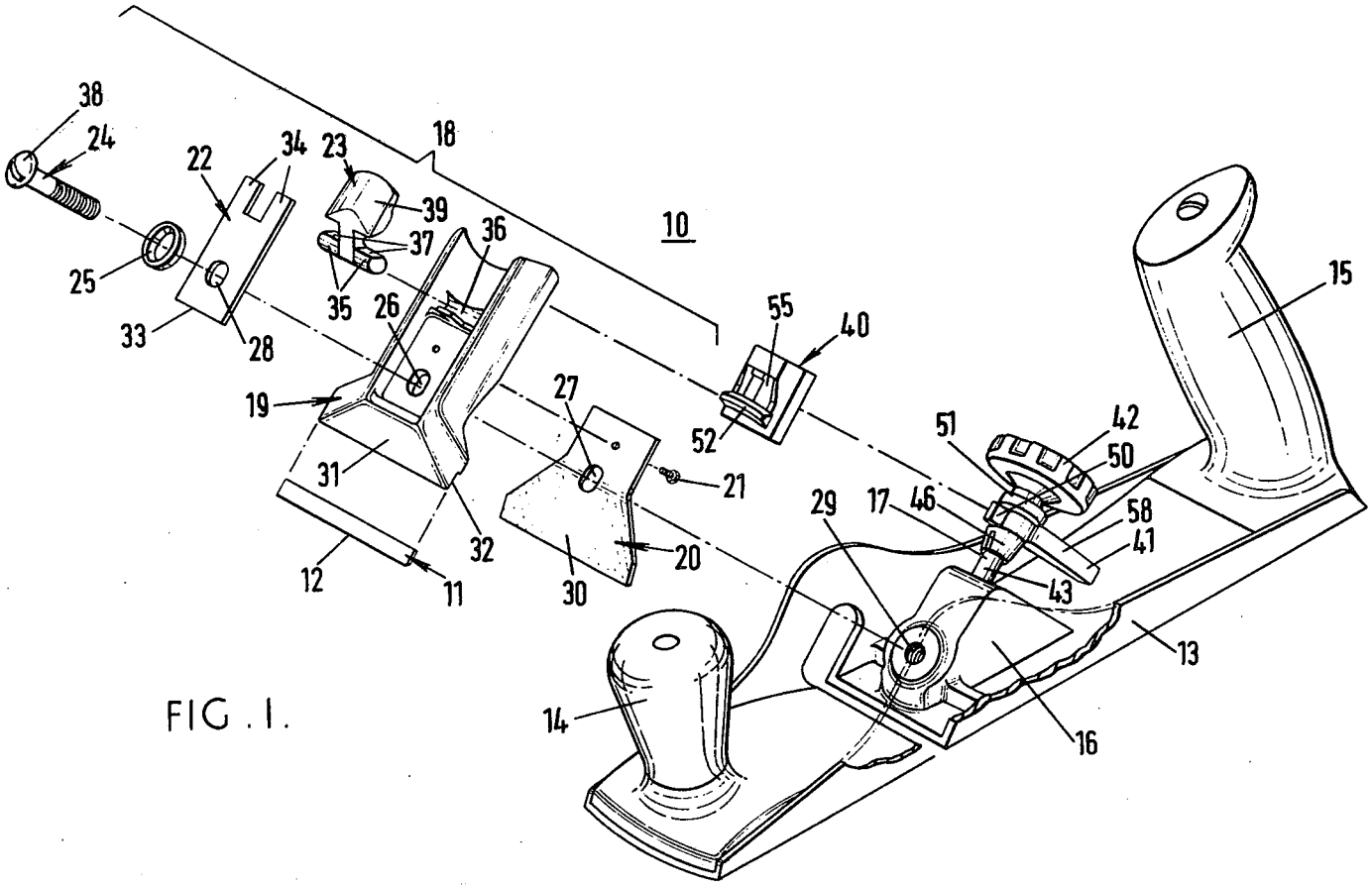
FIG. 1 is an exploded perspective view of a plane embodying the invention.
Figure 2:
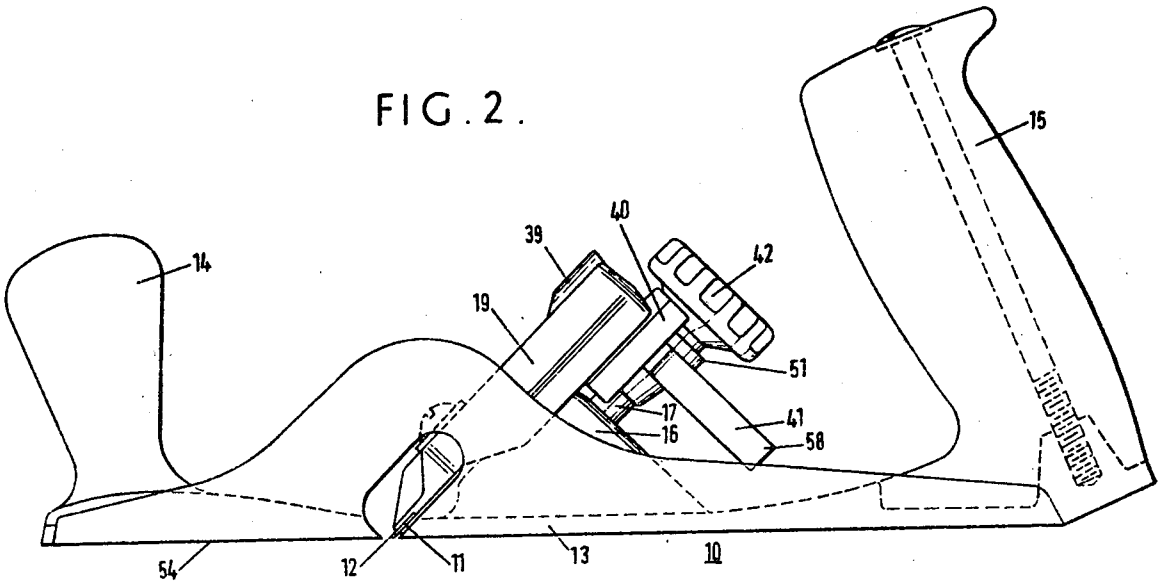
FIG. 2 is a side elevation of the plane of FIG. 1.
Figure 3:
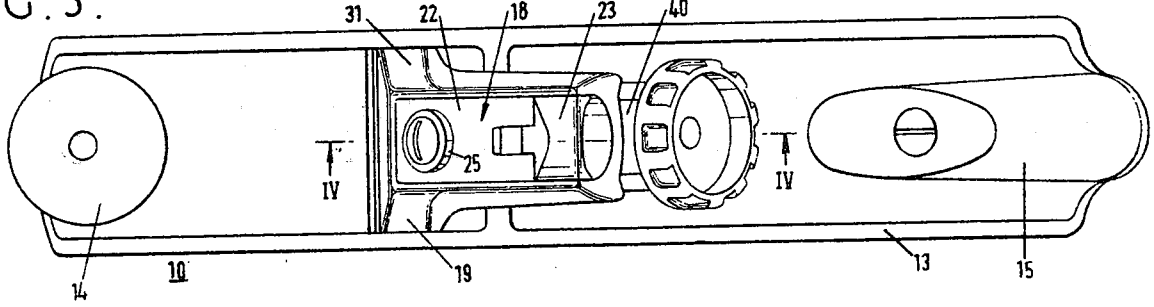
FIG. 3 is a plan view of the plane of FIGS. 1 and 2.

Referring to FIGS. 1 to 6 of the drawings, a plane 10 is adapted to be fitted with a disposable blade 11 whose maximum dimension is parallel to the direction of its cutting edge 12.

The plane 10 comprises a main metal body 13. Insofar as adjustments of the blade 11 are all relative to the body 13, the latter can be regarded as a "fixed part" of the plane, although in use the plane 10 is adapted to be hand-held and moved bodily over the surface of a workpiece (not shown) just like a conventional plane. Joined rigidly to the body 13 are a front handle 14 and a rear handle 15. A central metal block 16 is integral with the body 13. A screw-threaded metal stud 17 is rigidly fixed to and projects from the block 16.

The plane 10 further comprises a blade-holding part 18, the position of which is adjustable relative to the fixed part of the plane 10. The blade-holding part 18 comprises a rigid diecast metal member 19, a springy sheet metal member 20 secured to the underside of member 19 by a screw 21, an apertured metal bar member 22 and a quick-release member 23 of plastics. A metal bolt 24, fitted with metal, part-spherical sealing washer 25, extends through corresponding slots 26, 27 and 28 in members 19, 20 and 22 respectively into a screw-threaded hole 29 in the block 16. The bolt 24 serves both to hold the blade 11 clamped between members 19 and 20 and to secure the blade-holding part 18 to the block 16. Adjustability of the blade-holding part 18 is possible because the slots 26, 27 and 28 are elongate. The lower portion 30 of the springy sheet metal member 20 is self-biased away from the corresponding part 31 of rigid member 19, so that clamping of the blade 11 between members 19 and 20 is dependent on the bolt 24. Part 31 of member 19 is formed with a recess 32 (FIG. 1) to accommodate the blade 11.

The apertured bar member 22 is supported at its bottom end 33 on the part 31 of rigid member 19. The upper end of bar member 22 is forked into two arms 34, which rest upon trunnions 35 of quick-release lever 23. The trunnions 35 rest in a groove 36 in the rigid member 19, so that the lever 23 can pivot. Two flats 37 are formed on the trunnions 35. Normally the arms 34 do not rest upon the flats 37 and the bolt 24 is adjusted, the bolt head 38 bearing through washer 25 upon bar member 22, so that the blade 11 is firmly clamped between portions 30 and 31 of sheet metal member 20 and rigid member 19, against the springiness of the sheet metal member 20 and the slight "give" in the metal bar member 22 due to the trunnions 35 being of plastics. Referring to FIG. 4, if arm 39 of member 23 is raised from the position shown, the arms 34 of bar member 22 come to rest on the flats 37 of trunnions 35, causing the bar member 22 to drop slightly, pivoting at its bottom end 33 on rigid member 19. This loosens the bolt 24 and unclamps the blade 11, the springy member 20 opening up the gap between portions 30 and 31 of members 20 and 19.

The plane 11 also comprises a metal element 40, a slewing adjustment lever 41 of plastics and a rotary adjustment member 42 of plastics. The element 40 bears directly on an unthreaded portion 43 of stud 17 with a portion 44. A part-frusto-conical surface 45 (FIG. 6) of element 40 surrounds a frusto-conical portion 46 of lever 41. Another part-frusto-conical surface 47 of element 40 bears upon a frusto-conical portion 48 of rotary adjustment member 42. A groove 49 in element 40 receives a flange 51 of rotary member 42, which is screwed onto the stud 17. Accordingly, rotation of rotary adjustment member 42 in either direction causes member 42 to move up or down the stud 17 and to move the element 40 also up or down. The element 40 has a rib 52 which is tapered or wedge-shaped in cross-section and engages in a corresponding groove 53 in member 19 for moving member 19 up or down with element 40 to adjust the coarseness of cut, that is, the amount that blade 11 projects below the bottom surface 54 of body 13.

The sheet metal member 20 ensures that the blade 11 can move up and down or slew with member 19, instead of sticking on the plane body 13.

The wedge-shaped or tapered cross-section of the rib 52 and groove 53 eliminates play between element 40 and member 19 and also produces substantial friction therebetween, (the bolt 24 causing member 19 to bear down upon element 40,) so as to resist sideways movement of member 19 relative to element 40, so that inadvertent slewing of member 19 does not occur during use. However, the rib 52 and groove 53 are both arcuate, the arc centre being located on the centre of the cutting edge 12, so that deliberate slewing of member 19 is possible, for adjusting the level of the blade 11, if the friction is overcome between the rib 52 and groove 53.

The rib 52 of element 40 is much nearer to the portion 44, (which bears upon stud 17,) than it is to the part-frusto-conical surface 47) (which bears upon rotary adjustment member 42). Since the pressure of member 19 upon element 40 due to the tightness of the bolt 24 is through the rib 52 and groove 53, it follows that the force of element 40 via portion 44 upon stud 17 is much greater than the force of element 40 via surface 47 upon the rotary adjustment member 42. Thus the friction between rotary adjustment member 42 on the one hand and stud 17 and element 40 on the other hand is sufficiently low for member 42 to be easily rotatable.

For slewing adjustment of member 19, lever 41 has a projection 50 which projects through an aperture 55 in element 40 into a recess 56 between two ribs 57 of member 19. Due to the length of arm 58 of lever 41, relative to the shortness of projection 50, measured from the axis of stud 17, the lever 41 provides sufficient "mechanical advantage" for slewing of member 19 to be quite easy and for precise levelling of blade 11 to be possible.

Thus, in use, all that a user has to do to clamp a blade in the blade-holding part 18 is to raise arm 39, insert the blade, then lower arm 39. Then rotary adjustment member 42 is turned clockwise until the blade cutting edge 12 can be seen projecting well beyond body surface 54. Then arm 58 is moved if necessary to level the blade, the arrangement being such that movement of arm 58 to either side causes the blade to project further on that side, which is ergonomically a "natural" result. Finally, the rotary adjustment member 42 is rotated in the opposite direction to withdraw the blade until the cutting edge 12 is projecting beyond surface 54 by the required amount, depending on the desired coarseness of cut. Of course, the sequence of operations may be different from the above if some other sequence is preferred by the user.

The frusto-conical shape of surfaces 47 and 48 minimizes play between element 40 and rotary adjustment member 42.

FIGS. 7 to 12 illustrate modifications to the plane 10, for storage of spare blades in the rear handle.

Figure 9:
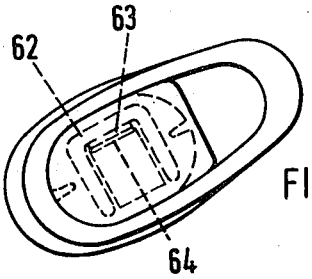
FIG. 9 is a view in the direction of arrow IX in FIG. 7.
Figure 8:
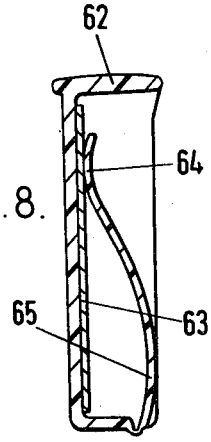
FIG. 8 is a section along line VIII—VIII of FIG. 7.
Figure 7:
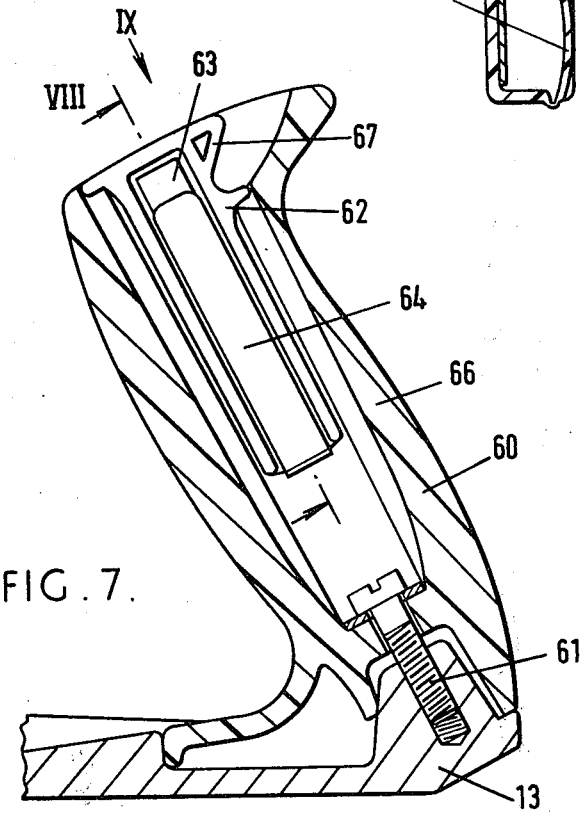
FIG. 7 is a side elevation section through the rear handle and part of the body of a modified plane.

More particularly, FIGS. 7, 8 and 9 show a modified rear handle 60 secured to body 13 by means of a bolt 61 and containing a removable magazine 62 of moulded plastics material, shown containing a spare blade 63 retained by a leaf spring 64 forming part of the magazine 62. A part 65 of spring 64 engages a suitable internal part (not shown) of the body 66 of handle 60 to retain the magazine 62 normally in the handle 60 by friction. In use, a projection 67 on magazine 62 can be engaged to lift out the magazine 62, whereupon blade 63 can be removed after lifting leaf spring 64 and the magazine 62 then replaced.

Figure 11:
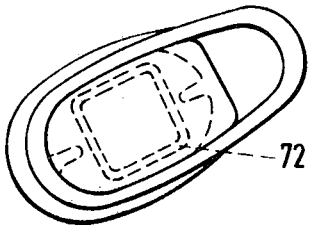
FIG. 11 is a view in the direction of arrow XI in FIG. 10.
Figure 10:
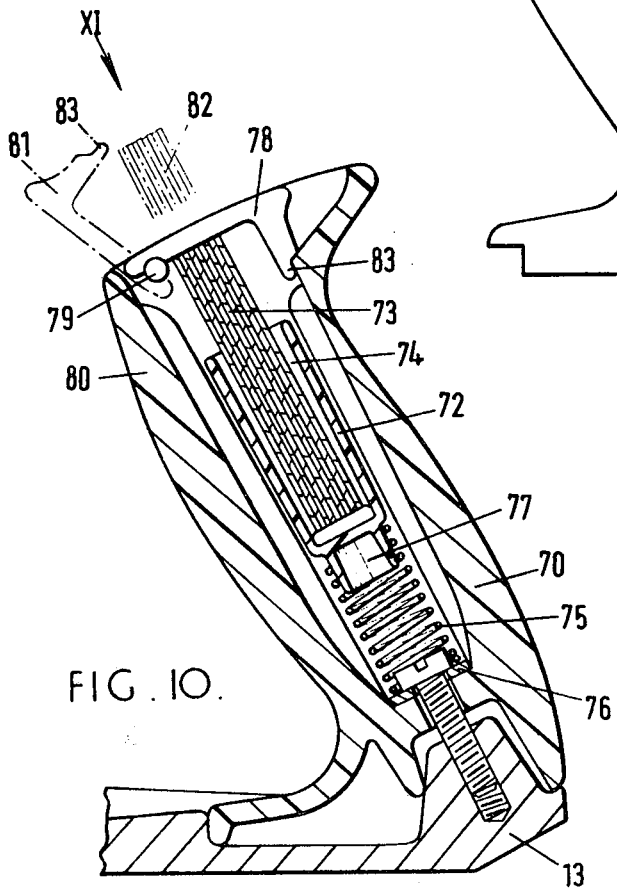
FIG. 10 is a side elevational section through the rear handle and part of the body of another modified plane.

FIGS. 10 and 11 show another modified handle 70 secured to body 13 by a bolt 71 and containing a reciprocable magazine 72 which contains spare blades 73 projecting out of the open upper end 74 of magazine 72. A compression spring 75 acts between a washer 76 in the bottom of handle 70 and the base 77 of magazine 72. A lid 78 is pivoted at 79 on the handle body 80 and normally holds the magazine 72 and blades 73 down by engaging the tops of blades 73 as shown. When lid 78 is flipped to the position 81 shown in chain-dot lines, the magazine 72 and blades 73 are pushed up by spring 75 so that blades 73 project out of the handle body 80 as shown at 82, whereupon one of the blades 73 can readily be extracted, after which the blades 73 and magazine 72 can be pushed down against spring 75 and the lid 78 can be closed, part 83 of lid 78 engaging a recess in body 80 to hold the lid 78 closed.

Figure 12:
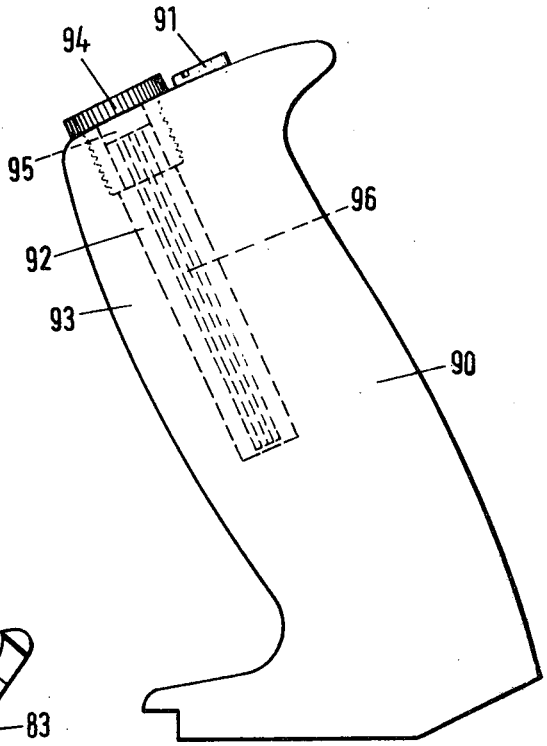
FIG. 12 is a side elevation of the rear handle of another modified plane.

FIG. 12 shows a handle 90 fitted with a securing bolt 91 for securing it to body 13, (not shown in FIG. 12,) with a recess 92 in the handle body 93. A cap 94 is screwed into the top of recess 92. A permanent magnet 95 forms part of cap 94 and spare blades 96 of steel stick magnetically to the cap 94. In use, the cap 94 can be unscrewed, a blade 96 pulled off magnet 95 and cap 94 replaced.

I claim:

1. A plane adapted to be fitted with a disposable blade of the type whose maximum dimension is parallel to the direction of the cutting edge of the blade comprising a main body having a rigid central block and a planar underside; a stud rigidly fixed to and projecting from said block; a blade holding assembly mounted on said block for adjustable movement relative thereto, said assembly comprising a blade support having a blade receiving recess on one surface, a blade retaining spring member secured to said one surface of said blade support and self-biased away from the support adjacent said recess, an elongated release plate and a quick release lever mounted on said support on the surface thereof opposite said one surface and a headed fastener retentively mounting said blade holding assembly on said block; said quick release lever including trunnions and said blade support having a groove on said opposite surface remote from said recess for receiving said trunnions, one end of said release plate being supported on said blade support and the other end being forked to provide a pair of arms resting on the trunnions of the quick release lever, said lever being selectively operable between a blade clamping position and a blade releasing position, the arrangement of the blade holding assembly being such that when the quick release lever is in its blade clamping position, the trunnions urge the arms away from the blade support causing the plate to bear against the headed bolt to clamp said spring member between said support and said block for clamping the blade in said blade receiving recess, said trunnions being formed with relieved portions adapted to engage the arms of the release plate when the quick release lever is in its blade releasing position to position the arms nearer the blade support whereby said spring member is unclamped and self-biases away from the blade support recess for releasing the blade; a rotary adjustment member threadably engaging said stud and operable for drivably advancing and retracting said blade holding assembly and an intermediate element for the blade holding assembly interposed between said assembly and the rotary adjustment member, said intermediate element engaging the rotary adjustment member so that rotation thereof in opposite directions causes advancement and retraction respectively of the element and assembly relative to the main body without rotation of the element; said intermediate element additionally permitting slewing of the blade holding assembly relative to said element.

2. A plane adapted to be fitted with a disposable blade of the type whose maximum dimension is parallel to the direction of the cutting edge of the blade comprising a main body having a rigid central block and a planar underside; a stud rigidly fixed to and projecting from said block, said stud having an unthreaded portion adjacent said block and a threaded portion remote from said block; a rotary adjustment member threadably engaging said threaded stud portion and having a frustoconical surface portion; a blade holding assembly mounted on said block for movement relative thereto for adjusting the coarseness of cut of a blade mounted therein; a slewing adjustment lever pivotally mounted on said stud; an intermediate element for said blade holding assembly having a portion bearing upon the unthreaded portion of the stud and a frustoconical surface portion in confronting surface engagement with the frustoconical portion of the rotary adjustment member, said element and rotary adjustment member being interengaged by a flange-in-groove connection whereby rotation of the rotary adjustment member in opposite directions causes movement of both the rotary adjustment member and element along said stud; said blade holding assembly comprising a blade support member having a blade receiving recess, a blade retaining member secured to said support, a bolt connecting the blade holding assembly to the block and means for releasably clamping the blade retaining member between the blade support and the block for clamping the blade in the blade receiving recess; said bolt connecting the blade holding assembly to the block in such a manner that said assembly can pivot about said bolt for slewing adjustment and can move relative to the block for coarseness of cut adjustment; said element and said blade support being provided with slideable rib-in-groove connecting means extending transversely of said stud; said connecting means exhibiting an arcuate configuration along the extent thereof to facilitate said pivotal slewing adjustment; said slewing adjustment lever having a projection engaging said blade support member whereby pivotal adjustment of the lever causes pivotal slewing adjustment of said assembly relative to said element.

3. A plane adapted to be fitted with a disposable blade of the type whose maximum dimension is parallel to the direction of the cutting edge of the blade comprising a main body having a rigid central block and a planar underside; a stud rigidly fixed to and projecting from said block, said stud having an unthreaded portion adjacent said block and a threaded portion remote from said block; a rotary adjustment member threadably engaging said threaded stud portion and having a frustoconical surface portion; a blade holding assembly mounted on said block for movement relative thereto for adjusting the coarseness of cut of a blade mounted therein; a slewing adjustment lever pivotally mounted on said stud; an intermediate element for said blade holding assembly interposed between said rotary adjustment member and said assembly and having a portion bearing upon the unthreaded portion of the stud and a frustoconical surface portion in confronting surface engagement with the frustoconical portion of the rotary adjustment member, said element and rotary adjustment member being interengaged by a flange-in-groove connection whereby rotation of the rotary adjustment member in opposite directions causes movement of both the rotary adjustment member and element along said stud; said blade holding assembly comprising a blade support having a blade receiving recess on one surface, a blade retaining spring member secured to said one surface of said blade support and self-biased away from the support adjacent said recess, an elongated release plate and a quick release lever mounted on said support on the surface opposite said one surface and a headed fastener retentively mounting said blade holding assembly on said block, said quick release lever including trunnions and said blade support having a groove on said opposite surface remote from said recess for receiving said trunnions, one end of said release plate being supported on said blade support and the other end being forked to provide a pair of arms resting on the trunnions of the quick release lever, said lever being selectively operable between a blade clamping position and a blade releasing position; the arrangement of the blade holding assembly being such that when the quick release lever is in its blade clamping position, the trunnions urge the arms away from the blade support causing the plate to bear against the headed bolt to clamp said spring member between said support and said block for clamping the blade in said blade receiving recess, said trunnions being formed with relieved portions adapted to engage the arms of the release plate when the quick release lever is in its blade releasing position to position the arms nearer the blade support whereby said spring member is unclamped and self-biases away from the blade support recess for releasing the blade; said headed fastener connecting the blade holding assembly to the block in such a manner that said assembly can pivot about said fastener for slewing adjustment and can move relative to the block for coarseness of cut adjustment; said element and said blade support being provided with slideable rib-in-groove connecting means extending transversely of said stud; said connecting means exhibiting an arcuate configuration along the extent thereof to facilitate said pivotal slewing adjustment; said slewing adjustment lever having a projection engaging said blade support member whereby pivotal adjustment of the lever causes pivotal slewing adjustment of said assembly relative to said element.

* * * * *